US005595862A

United States Patent [19]

Fant et al.

[11] Patent Number: 5,595,862

[45] **Date of Patent: *Jan. 21, 1997**

[54] PHOTOGRAPHIC ELEMENTS CONTAINING MATTE PARTICLES OF BIMODAL SIZE DISTRIBUTION

[75] Inventors: Alfred B. Fant, Rochester; Yongcai Wang, Penfield; Dennis E. Smith, Rochester; Melvin M. Kestner, Hilton; Rudolf D. Steinmetz, Rochester, all of N.Y.

[73] Assignee: Eastman Kodak Company, Rochester, N.Y.

[ * ] Notice: The term of this patent shall not extend beyond the expiration date of Pat. No. 5,550,011.

[21] Appl. No.: 533,625

[22] Filed: Sep. 25, 1995

Related U.S. Application Data

[63] Continuation-in-part of Ser. No. 381,803, Feb. 1, 1995, Pat. No. 5,550,011.

[51] Int. Cl.[6] ..... G03C 1/76; G03C 1/00; G03C 3/00

[52] U.S. Cl. ..... 430/537; 430/496; 430/950; 430/961; 430/536

[58] Field of Search ..... 430/523, 531, 430/537, 539, 950, 961

[56] References Cited

U.S. PATENT DOCUMENTS

| | | | |
|---|---|---|---|
| 4,092,168 | 5/1978 | Lemahieu et al. | 96/84 R |
| 4,232,117 | 11/1980 | Naoi et al. | 430/539 |
| 4,820,615 | 4/1989 | Vandenabeele et al. | 430/531 |
| 4,975,363 | 12/1990 | Cavallo et al. | 430/637 |
| 5,061,595 | 10/1991 | Gingello et al. | 430/264 |
| 5,104,777 | 4/1992 | Schmidt et al. | 430/510 |
| 5,175,073 | 12/1992 | Gingello et al. | 430/264 |
| 5,378,577 | 1/1995 | Smith et al. | 430/536 |

FOREIGN PATENT DOCUMENTS

| | | |
|---|---|---|
| 4-322247 | 11/1992 | Japan . |
| 6/118542 | 4/1994 | Japan . |

*Primary Examiner*—Glenna A. Caldarola
*Assistant Examiner*—J. Pasterczyk
*Attorney, Agent, or Firm*—Robert A. Gerlach

[57] ABSTRACT

In accordance with the present invention, a photographic element comprises a support, at least one light-sensitive layer, and a protective overcoat comprising a hydrophilic binder and permanent matte particles, the permanent matte particles comprising a polymer of methyl methacrylate and having a size distribution of a first and a second mode, with the first mode being composed of particles having a mean particle size of from 0.2 to 1.2 micrometers in a coating weight of from 10 to 200 mg/m$^2$ and the second mode having a mean particle size of from 1.5 to 10 micrometers in a coating weight of from 5 to 150 mg/m$^2$, the total coating weight of the particle of the first and the second modes being greater than 100 mg/m$^2$.

15 Claims, No Drawings

PHOTOGRAPHIC ELEMENTS CONTAINING MATTE PARTICLES OF BIMODAL SIZE DISTRIBUTION

This application is a continuation-in-part of U.S. application Ser. No. 08/381,803, filed Feb. 1, 1995, now U.S. Pat. No. 5,550,011.

FIELD OF THE INVENTION

This invention relates to imaging elements and more particularly to photographic imaging elements with improved image quality in photographic printing and projection, enhanced ferrotyping protection both before and after processing, and increased resistance to matte cinch scratch and abrasion in the manufacturing and use of such photographic elements.

BACKGROUND OF THE INVENTION

Photographic elements generally comprise hydrophilic binders, e.g., gelatin as vehicles for the image chemistry and in the protective overcoat. These hydrophilic colloids can absorb moisture and become tacky in humid environments and at elevated temperatures causing the photographic materials to stick to each other, for example, if packed in a stack. To eliminate these difficulties, it is conventional to incorporate finely divided powdered grains or matting agents (beads) into the protective layer to increase the surface roughness and prevent contact and subsequent sticking. It is desirable that these matte beads are non-hydrophilic and consequently they are composed of materials different from the hydrophilic binders. Thus, they typically have a different refractive index. When light is passed through the photographic element, such as in photographic printing or projection, both the increased surface roughness and difference in refractive index causes a non-uniform light path and results in graininess in photographic prints or mottle in projected images. For these reasons, manufacturers have been using a large amount of processing removable (soluble) mattes, designed to solubilize in high pH solutions, in combination with a small amount of process surviving (permanent) matte. High concentrations of processing removable matte are used especially when the unprocessed photographic elements are used or stored at high relative humidity and at elevated temperatures of from 30° to 40° C. High concentrations of soluble matte are also used to prevent contact specks which cause adverse sensitometric defects when the materials are rolled up.

The use of a high level of processing removable matte provides a satisfactory solution to conventional films for amateur use, for which the processed, or developed, film strips are returned to the consumer in synthetic resin pouches, or sleeves, where the front side and back side of the film do not come in contact with each other.

Recent patents have disclosed photographic systems where the processed element may be re-introduced into a cassette. This system allows for compact and clean storage of the processed element until such time when it may be removed for additional prints or to interface with display equipment. Storage in the cassette is preferred to facilitate location of the desired exposed frame and to minimize contact with the negative during subsequent usage. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette. The dimensions of such a so-called thrust cassette requires that the processed photographic element is wound tightly and under pressure, causing direct close contact between the front and back sides which results in ferrotyping, especially at high temperature and high relative humidity. Processing removable matte does not prevent this problem.

In recent years, rapid processing and high temperature drying after processing have become common practice for photographic materials. Films dried at high temperatures, for example 60° C. (harsh drying), tend to be more prone to ferrotyping which results from close contact, especially under elevated humidity and temperature. When ferrotyping is sufficiently severe, the resulting prints are unacceptable. Films dried at lower temperatures, for example 40° C. (mild drying), tend to show much less ferrotyping. The reason for this difference is not understood.

The reintroduction of processed photographic elements into thrust cassettes also causes scratches and abrasion marks on the side opposite to that containing matte particles. Such scratches and abrasion marks deface the photographic image quality and therefore very expensive retouching is often required.

Recently, significant advancements have been made with regard to the methods of preparing photographic material. For example, the speed of coating, finishing, and cutting has been increased. These improvements have also resulted in a significant increase in the amount of scratches and abrasion marks on the side opposite to that containing matte particles.

Moreover, recent improvements have also been made to the image quality of the photographic materials in regard to the nonuniformity, or graininess, of the resulting prints by improving the imaging layer structures (e.g., developed grains, dispersions, etc.). The graininess is generally measured by RMS granularity, wherein the variability of the density in a specific region of uniform exposure is measured. The definition of statistical variance in density can be found, for example, in "Introduction to Photographic Theory—The Silver Halide Process", Carroll, B. H., Higgins, G. C., James, T. H., published by John Wiley & Sons, 1980. The overall variance in density σ(d) is given by $$\sigma^2(d)=\sigma^2(\text{image})+\sigma^2(\text{matte})+\sigma^2(\text{test})+\text{error}$$

where $\sigma^2$(image) accounts for the density variation due to image structures and $\sigma^2$(matte) accounts for the density variation due to the presence of matte particles. As reductions in the $\sigma^2$(image) have been made in recent years, the impact of the $\sigma^2$(matte) has become even more critical. It has been common to reduce the impact of the $\sigma^2$(matte) by reducing the specularity of the printing method, but this technique can limit the productivity of photographic printers. In addition, recent storage and display devices, such as PhotoCD and other means of electronic display all make use of specular transmission of the photographic element. Therefore, there is clearly a need to reduce the magnitude and impact of $\sigma^2$(matte) on image quality without sacrificing the ferrotyping protection offered by matting agents on the post process photographic element.

SUMMARY OF THE INVENTION

An aspect of the present invention is to provide an improved protective overcoat layer that facilitates the use of photographic elements in humid environments and at elevated temperatures with improved ferrotyping performance both before and after processing.

Another aspect of the invention is to provide photographic elements with improved image quality in photographic printing and projection.

A further aspect is to provide photographic elements with superior resistance to matte cinch scratch and abrasion in manufacture and use.

The present invention provides a photographic element comprising a support, at least one light sensitive layer, and a protective overcoat comprising a hydrophilic binder and permanent matte particles, the permanent matte particles comprising a polymer of methyl methacrylate and having a size distribution of a first and a second mode, with the first mode being composed of particles having a mean particle size of from 0.2 to 1.2 micrometers in a coating weight of from 10 to 200 mg/m$^2$ and the second mode having a mean particle size of from 1.5 to 10 micrometers in a coating weight of from 5 to 150 mg/m$^2$, the total coating weight of the particle of the first and the second modes being greater than 100 mg/m$^2$.

The photographic elements in accordance with this invention demonstrate good image quality and superior resistance to matte cinch scratches and abrasions, and are surprisingly insensitive to drying conditions in photographic processors. Good ferrotyping protection is also retained even when the element is subjected to harsh drying conditions.

DESCRIPTION OF PREFERRED EMBODIMENTS

This invention contemplates photographic elements having a support, at least one light-sensitive layer, and a protective overcoat located further from the support than the light-sensitive layer. The protective overcoat layer includes permanent matte particles preferably comprising greater than 80 mole percent of methyl methacrylate in a hydrophilic binder. The matte particles have a heterogeneous size distribution, and in particular a bimodal distribution. The particles of the first mode have a mean particle size of from 0.2 to 1.2 μm, preferably from 0.5 to 1.2 μm, and most preferably from 0.7 to 1.2 μm. The particles of the first mode are present in the protective overcoat in a coverage of from 10 to 200 mg/m$^2$, preferably from 30 to 170 mg/m$^2$, and most preferably from 50 to 170 mg/m$^2$. The particles of the second mode have a mean particle size of from 1.5 to 10 μm, preferably from 1.5 to 5 μm, and most preferably from 1.5 to 3 μm. The particles of the second mode are present in the protective layer in a coverage of from 25 to 150 mg/m$^2$, preferably from 25 to 120 mg/m$^2$, and most preferably from 50 to 100 mg/m$^2$. The measurement and interpretation of particles with such bimodal size distribution have been described in detail by, for example, R. R. Irani and C. F. Callis (*Particle Size: Measurement, Interpretation, and Application*, John Wiley & Sons, Inc. 1963), and J. M. Dallavalle, C. Orr. and H. G. Blocker (*Ind. Eng. Chem.*, 43, 1377, (1951)).

Matte particles in the present invention can be of essentially any shape. The mean diameter of a particle is defined as the diameter of a spherical particle of identical volume. In some embodiments, it may be preferable to have matte particles that are in the form of spherical beads having diameters in the size ranges described above.

In the present invention, the permanent matte particles are added to a light -insensitive protective overcoat layer, with the overall coated amount being above 100 mg/m$^2$. The protective layer can be located directly on the top of a light sensitive layer or can be used together with an ultraviolet ray protective layer or an interlayer. In general, the protective layer of the present invention has a thickness of from 0.2 to 3 μm, and preferably from 0.5 to 2 μm, and most preferably from 0.6 to 1.5 μm. A very thick protective layer will diminish the matting effect and a very thin layer will adversely affect the matte particle adhesion. It is preferred that the thickness of the protective overcoat layer be less than the mean particle size of the second mode.

Photographic elements according to this invention can differ widely in structure and composition. For example, they can vary greatly in regard to the type of the support, the number and composition of the imaging forming layers, and the kinds of auxiliary layers that are included in the elements. Typical supports include cellulose nitrate film, cellulose acetate film, poly(vinyl acetal) film, polystyrene film, poly(ethylene terephthalate) film, poly(ethylene naphthalate) film, polycarbonate film, and the like.

The matte particles for use in accordance with this invention can be made by various well-known techniques in the art, such as, for example, crushing, grinding or pulverizing of polymer down to the desired size, emulsion polymerization, dispersion polymerization, suspension polymerization, solvent evaporation from polymer solution dispersed as droplets, and the like (see, for example, Arshady, R. in "Colloid & Polymer Science", 1992, No 270, pages 717–732; G. Odian in "Principles of Polymerization", 2nd Ed. Wiley(1981); and W. P. Sorenson and T. W. Campbell in "Preparation Method of Polymer Chemistry", 2nd Ed, Wiley (1968)). A method of preparing matte particles in accordance with this invention is by a limited coalescence technique where polyaddition polymerizable monomer or monomers are added to an aqueous medium containing a particlulate suspending agent to form a discontinuous (oil droplet) phase in a continuous (water) phase. The mixture is subjected to shearing forces, by agitation, homogenization and the like to reduce the size of the droplets. After shearing is stopped an equilibrium is reached with respect to the size of the droplets as a result of the stabilizing action of the particulate suspending agent in coating the surface of the droplets and then polymerization is completed to form an aqueous suspension of polymer particles. This process is described in U.S. Pat. Nos. 2,932,629; 5,279,934; and 5,378,577 incorporated herein by reference. A preferred method of preparing matte particles in accordance with this invention is by a process including forming a suspension or dispersion of ethylenically unsaturated monomer droplets in an aqueous media, subsequent to the formation of the droplets and before the commencement of the polymerization reaction, adding to the aqueous media an effective amount of a hydrophilic colloid such as gelatin and polymerizing the monomer to from solid polymer particles.

The permanent matte particles of the present invention preferably contain greater than 80 mole percent methyl methacrylate. For example, the matte particles can be heterogeneous, containing other addition polymers, condensation polymers, inorganic fillers, and the like. Inorganic fillers, for example, include silicon dioxide, tin oxide, antimony doped tin oxide, aluminum oxide, iron oxide, metal antimonates, and the like. Suitable condensation polymers include polyesters, polyurethanes, polycarbonates, polyamides, polyanalines, polythiophenes, and the like. Suitable polyaddition polymers other than methyl methacrylate include any of those made from the following monomers including acrylic monomers, including acrylic acid and their alkyl esters, such as, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate; the hydroxyalkyl esters of the same acids, such as, 2-hydroxyethyl acrylate, 2-hydroxyethyl methacrylate, and 2-hydroxypropyl methacrylate; and the nitrile and amides of the same acids, such as, acrylonitrile, methacrylonitrile, acrylamide and methacrylamide; vinyl monomers, such as, vinyl acetate, vinyl propionate, vinylidene chloride, vinyl chloride, and vinyl aromatic compounds such as styrene, t-butyl styrene and vinyl toluene and the like. Other comonomers which may be used in combination with any of the foregoing monomers include dialkyl maleates, dialkyl itaconates, dialkyl methylene-malonates, isoprene, and butadiene. In addition, crosslinking comonomers can be used to crosslink the polymer particles of the present invention to effectively increase the glass transition temperature of the particles. These are monomers which are polyfunctional with respect to the polymerization reaction, and include esters of unsaturated monohydric alcohols with unsaturated monocarboxylic acids, such as, allyl methacrylate, allyl acrylate, butenyl acrylate, undecenyl acrylate, undecenyl methacrylate, vinyl acrylate, and vinyl methacrylate; dienes such as butadiene and isoprene; esters of saturated glycols or diols with unsaturated monocarboxylic acids, such as ethylene glycol diacrylate, ethylene glycol dimethacrylate, triethylene glycol dimethacrylate, 1,4-butanediol dimethacrylate, 1,3-butanediol dimethacrylate; and polyfunctional aromatic compounds such as divinyl benzene.

The permanent matte particles also may include mixtures of particles wherein 80 percent of the particles present in the mixture are polymethylmethacrylate and up to 20 percent of the particles can include any of the materials heretofore mentioned.

The permanent matte particles may also be copolymers of greater than 80 mole percent of methyl methacrylate and up to 20 mole percent of any other ethylenically unsaturated monomers, such as, those specifically set forth above with respect to heterogeneous particles. It should be understood that the composition of the methyl methacrylate particles of the first mode and the composition of the methyl methacrylate particles of the second mode need not be the same.

Preferably, the permanent matte particles of the present invention are a copolymer of methyl methacrylate and another ethylenically unsaturated monomer. More preferably, the copolymer is at least 90 mole percent methyl methacrylate. Most preferably, the matte particles are 100 mole percent methyl methacrylate.

The matte particle surface may include reactive functional groups which form covalent bonds with binders by intermolecular crosslinking or by reaction with a crosslinking agent (i.e., a hardener). Suitable reactive functional groups include: hydroxyl, carboxyl, carbodiimide, epoxide, aziridine, vinyl sulfone, sulfinic acid, active methylene, amino, amide, allyl, and the like. There is no particular restriction on the amount of reactive groups present, but their concentrations are preferably in the range of from 0.5 to 10 weight percent. The particle surface may be surrounded with a layer of colloidal inorganic particles as described in U.S. Pat. No. 5,288,598, or a layer of colloidal polymer latex particles which have affinity with suitable binder as described in U.S. Pat. No. 5,279,934, or a layer of gelatin as described in U.S. Pat. No. 4,855,219.

Processing removable mattes may be used together with the matte particles in the practice of the invention. Such processing removable mattes include particles of, for example, copolymers of alkyl (meth)acrylates and methacrylic acid, or acrylic acid, or itaconic acid, copolymers of alkyl (meth)acrylates and maleic monoesters or monoamides, copolymers of styrene or vinyl toluene and α,β-unsaturated mono- or di-carboxylic acids, or dicarboxylic monoesters or monoamides, graft copolymers containing maleic anhydride or methacrylic acid, and dicarboxylic acid mono-ester of a cellulose derivative, such as phthalate and hexahydro phthalate of methyl cellulose, hydroxyethyl cellulose, or hydroxypropylomethyl cellulose. Such processing soluble mattes are described in further detail in U.S. Pat. Nos. 2,992,101; 3,767,448; 4,094,848; 4,447,525; and 4,524,131.

Any suitable hydrophilic binder can be used in the practice of this invention, such as naturally occurring substances such as proteins, protein derivatives, cellulose derivatives (e.g., cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. Gelatin is the most preferred hydrophilic binder.

Gelatin can be used together with other water dispersible polymers as binders in the practice of the present invention. The water dispersible polymers can be incorporated into either light sensitive or light-insensitive layers. Suitable water dispersible polymers include both synthetic and natural water dispersible polymers. Synthetic water dispersible polymers may contain a nonionic group, an anionic group, or a nonionic group and an anionic group in the molecular structure. The nonionic group may be, for example, an ether group, an ethylene oxide group, an amide group, or a hydroxyl group. The anionic group may be, for example, a sulfonic acid group or the salt thereof, a carboxylic acid group or the salt thereof, or a phosphoric acid group or the salt thereof. The natural water soluble polymer may include a nonionic group, an anionic group, or a nonionic group and an anionic group in the molecular structure. The water dispersible polymers may be incorporated into the photographic materials of the present invention in an amount of preferably at least 0.5 percent, preferably from 1 to 50 percent, and most preferably from 2 to 30 percent based on the amount of the whole coated amount of gelatin on the side having a layer containing the matte particle of the present invention.

Water dispersible polymers useful for the present invention include vinyl polymer latex particles prepared by an emulsion polymerization process, water-borne polyurethane dispersions, water-borne epoxy dispersions, water-borne polyester dispersions, and the like. The mean size of the dispersed particles is within the range of from 0.01 to 0.2 μm, preferably from 0.02 to 0.1 μm.

The binder should be chosen so that it effectively adheres the matte particles to the surface of the element. For a crosslinkable binder such as gelatin, the binder is preferably cross-linked so as to provide a high degree of cohesion and adhesion. Crosslinking agents or hardeners which may effectively be used in the coating compositions of the present invention include aldehydes, epoxy compounds, polyfunctional aziridines, vinyl sulfones, melamines, triazines, polyisocyanates, dioxane derivatives such as dihydroxydioxane, carbodiimides, chrome alum, zirconium sulfate, and the like.

Any lubricant can be used in the outermost layer of the present invention. Typical lubricants include (1) silicone based materials disclosed, for example, in U.S. Pat. Nos. 3,489,567; 3,080,317; 3,042,522; 4,004,927; and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964; in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethlyene), poly(trifluorochloroethylene), poly(vinylidene fluoride), poly(trifluorochloroethylene-co-vinyl chloride), poly(meth)acrylates or poly(meth)acrylamides containing perfluoroalkyl side groups, and the like. Lubricants useful in the present invention are described in further detail in Research Disclosure No.308, published Dec. 1989, page 1006.

The protective layer useful in the practice of the invention may optionally contain surface active agents, antistatic agents, charge control agents, thickeners, ultraviolet ray absorbers, processing removable dyes, high boiling point solvents, silver halide particles, colloidal inorganic particles, magnetic recording particles, and various other additives.

The matte-containing layer useful in the practice of the invention can be applied by any of a number of well-know techniques, such as dip coating, rod coating, blade coating, air knife coating, gravure coating and reverse roll coating, extrusion coating, slide coating, curtain coating, and the like. After coating, the protective layer is generally dried by simple evaporation, which may be accelerated by known techniques such as convection heating. Known coating and drying methods are described in further detail in Research Disclosure No. 308, Published Dec. 1989, pages 1007 to 1008.

The photographic element of the present invention can contain at least one electrically conductive layer, which can be either a surface protective layer or a sub layer. The surface resistivity of at least one side of the support is preferably less than $1\times10^{12}$ Ω/square, more preferably less than $1\times10^{11}$ Ω/square at 25 ° C. and 20 percent relative humidity. To lower the surface resistivity, a preferred method is to incorporate at least one type of electrically conductive material in the electrically conductive layer. Such materials include both conductive metal oxides and conductive polymers or oligomeric compounds. Such materials have been described in detail in, for example, U.S. Pat. Nos. 4,203,769; 4,237,194; 4,272,616; 4,542,095; 4,582,781; 4,610,955; 4,916,011; and 5,340,676.

The present invention is also directed to a single-use camera having incorporated therein a photographic element as described above. Single-use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the product to the consumer does not normally occur.

Single-use cameras and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The photographic processing steps to which the raw film may be subject may include, but are not limited to the following:

(1) color developing→bleach fixing→washing/stabilizing;
(2) color developing→bleaching→fixing washing/stabilizing;
(3) color developing→bleaching→bleach-fixing→washing/stabilizing;
(4) color developing→stopping→washing→bleaching→washing→fixing→washing/stabilizing;
(5) color developing→bleach-fixing→fixing→washing/stabilizing;
(6) color developing→bleaching→bleach-fixing→fixing→washing/stabilizing;

Among the processing steps indicated above, the steps (1), (2), (3), and (4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

The following examples are intended to illustrate the present invention. However, it should be understood that the invention is not limited to these illustrative examples. The types and sizes of the matte particles used in the examples are listed in Table 1:

TABLE 1

MATTE PARTICLES

| Particle No. | Composition | Mean Particle Size (μm) |
|---|---|---|
| P-1 | Poly(methyl methacrylate) | 0.8 |
| P-2 | Poly(methyl methacrylate) | 1.7 |
| P-3 | Poly(methyl methacrylate) | 2.4 |
| P-4 | Poly(vinyl toluene-co-divinyl benzene) 80/20 | 1.5 |
| P-5 | Poly(methyl methacrylate-co-methacrylic acid) 45/55 | 3.0 |
| P-6 | Poly(vinyl toluene-co-divinyl benzene) 80/20 | 0.8 |

SAMPLE 1 to 4 AND EXAMPLES 1 to 2

A series of photographic elements are prepared as follows: A poly(ethylene naphthalate) support having an antihalation layer on one side and an antistatic layer overcoated with a magnetic recording layer on the other side is coated on the antihalation layer with the following imaging forming layer in sequence.

Interlayer:

This layer comprises 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Cyan Dye-forming Layer:

This layer comprises a red sensitive silver bromoiodide emulsion (3.3 mole percent iodide) (0.324 μm grain size) (0.387 g/m$^2$ silver), compound CC-1 (0.355 g/m$^2$), IR-4 (0.011 g/m$^2$), B-1 (0.075 g/m$^2$), S-2 (0.377 g/m$^2$), S-3 (0.098 g/m$^2$), and gelatin (1.64 g/m$^2$).

Mid Cyan Dye-forming Layer:

This layer comprises a blend of a red sensitive silver bromoiodide emulsion (3.3 mole percent iodide) (0.488 μm grain size) (0.816 g/m$^2$ silver) and a red sensitive, tabular grain, silver bromoiodide emulsion (4.5 mole percent iodide) (0.98 μm diameter by 0.11 μm thick) (0.215 g/m$^2$ silver), compound CC-1 (0.183 g/m$^2$), IR-3 (0.054 g/m$^2$), B-1 (0.027 g/m$^2$), CM-1 (0.011 g/m$^2$), S-2 (0.183 g/m$^2$), S-3 (0.035 g/m$^2$), S-5 (0.054 g/m$^2$), and gelatin (1.35 g/m$^2$).

Fast Cyan Dye-forming Layer:

This layer comprises a red sensitive, tabular grain, silver bromoiodide emulsion (4.5 mole percent iodide) (1.10 μm diameter by 0.11 μm thick) (1.08 g/m$^2$ silver), compound CC-1 (0.161 g/m$^2$), IR-3 (0.038 g/m$^2$), IR-4 (0.038 g/m$^2$), CM-1 (0.032 g/m$^2$), S-2 (0.237 g/m$^2$), S-5 (0.038 g/m$^2$), and gelatin (1.35 g/m$^2$).

Interlayer:

This layer comprises 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Magenta Dye-forming Layer:

This layer comprises a blend of a green sensitive, tabular grain, silver bromoiodide emulsion (1.5 mole percent iodide) (0.7 μm diameter by 0.112 μm thick) (0.258 g/m$^2$ Ag), and a green sensitive, tabular grain, silver bromoiodide emulsion (1.3 mole percent iodide) (0.54 μm diameter by 0.086 μm thick) (0.409 g/m$^2$ Ag), compound M-1 (0.204 g/m$^2$), MM-1 (0.038 g/m$^2$), ST-1 (0.020 g/m$^2$), S-1 (0.26 g/m$^2$), and gelatin (1.18 g/m$^2$).

Mid Magenta Dye-forming Layer:

This layer comprises a green sensitive, tabular grain, silver bromoiodide emulsion (4.5 mole percent iodide) (0.61 μm diameter by 0.12 μm thick) (0.646 g/m$^2$ Ag), compound M-1 (0.099 g/m$^2$), MM-1 (0.027 g/m$^2$), IR-2 (0.022 g/m$^2$), ST-1 (0.010 g/m$^2$), S-1 (0.143 g/m$^2$), S-2 (0.044 g/m$^2$), and gelatin (1.41 g/m$^2$).

Fast Magenta Dye-forming Layer:

This layer comprises a green sensitive, tabular grain, silver bromoiodide emulsion (4.5 mole percent iodide) (0.98 μm diameter by 0.113 μm thick) (0.699 g/m$^2$ Ag), compound M-1 (0.052 g/m$^2$), MM-1 (0.032 g/m$^2$), IR-2 (0.022 g/m$^2$), ST-1 (0.005 g/m$^2$), S-1 (0.111 g/m$^2$), S-2 (0.044 g/m$^2$), and gelatin (1.123 g/m$^2$).

Yellow Filter Layer:

This layer comprises 2,5-di-t-octyl-1,4-dihydroxy benzene (0.075 g/m$^2$), YD-2 (0.108 g/m$^2$), Irganox 1076 sold by Ciba Geigy (0.01g/m$^2$), S-2 (0.121 g/m$^2$) and gelatin (0.861 g/m$^2$).

Slow Yellow Dye-forming Layer:

This layer comprises a blend of a blue sensitive, tabular grain, silver bromoiodide emulsion (4.5 mole percent iodide) (1.4 μm diameter by 0.131 μm thick) (0.161 g/m$^2$ Ag), a blue sensitive, tabular grain, silver bromoiodide emulsion (1.5 mole percent iodide) (0.85 μm diameter by 0.131 μm thick) (0.0.108 g/m$^2$ Ag), and a blue sensitive, tabular grain, silver bromoiodide emulsion (1.3 mole percent iodide) (0.54 μm diameter by 0.086 μm thick) (0.161 g/m$^2$ Ag), compound Y-1 (0.915 g/m$^2$), IR-1 (0.032 g/m$^2$), B-1 (0.0065 g/m$^2$), S-1 (0.489 g/m$^2$), S-3 (0.0084 g/m$^2$), and gelatin (1.668 g/m$^2$).

Fast Yellow Dye-forming Layer:

This layer comprises a blue sensitive, tabular grain, silver bromoiodide emulsion (4.5 mole percent iodide) (2.3 μm diameter by 0.128 μm thick) (0.43 g/m$^2$ Ag), compound Y-1 (0.15 g/m$^2$), IR-1 (0.032 g/m$^2$), B-1 (0.0054 g/m$^2$), S-1 (0.091 g/m$^2$), S-3 (0.0070 g/m$^2$), and gelatin (0.753 g/m$^2$).

UV Protective Layer:

This layer comprises compound UV-1 (0.111g/m$^2$), UV-2 (0.111 g/m$^2$)S-4 (0.222 g/m$^2$), silver bromide Lippmann emulsion (0.215 g/m$^2$ Ag), and gelatin (0.7 g/m$^2$ ).

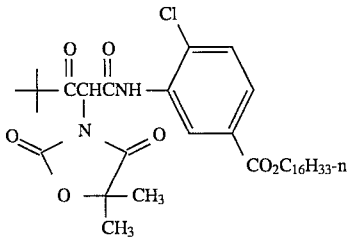

Y1

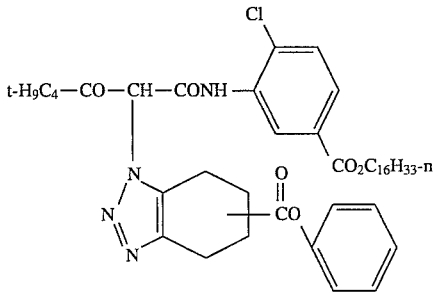

IR-1

-continued
YD-2
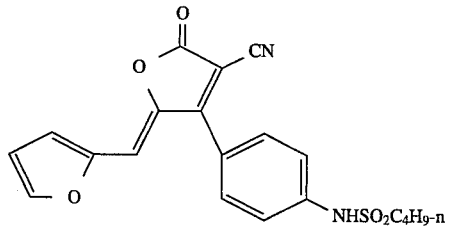
ST-1
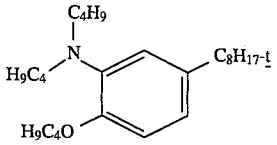
IR-2
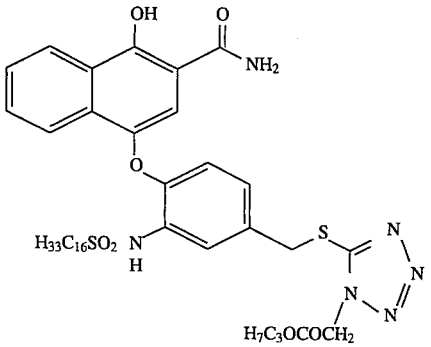
IR-3
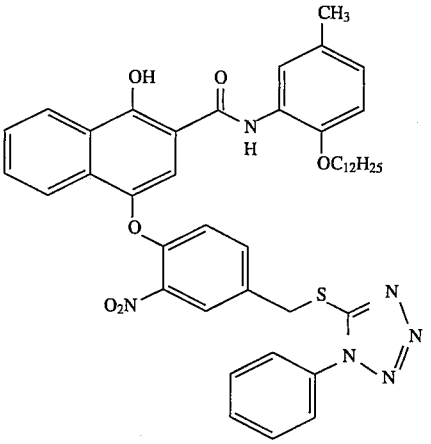
IR-4
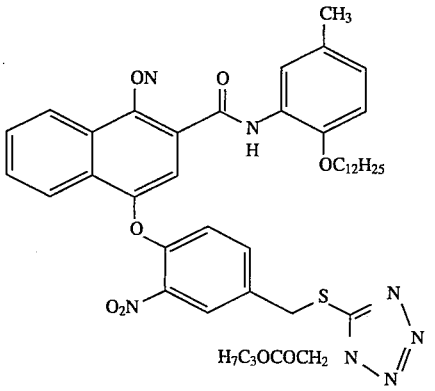

-continued
B-1
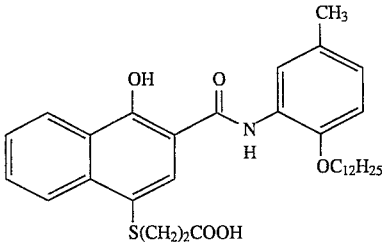
M-1
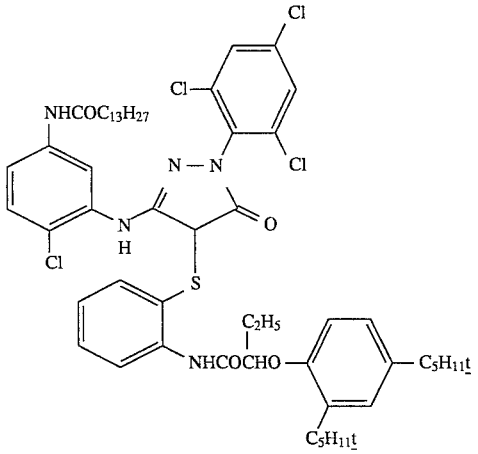
MM-1
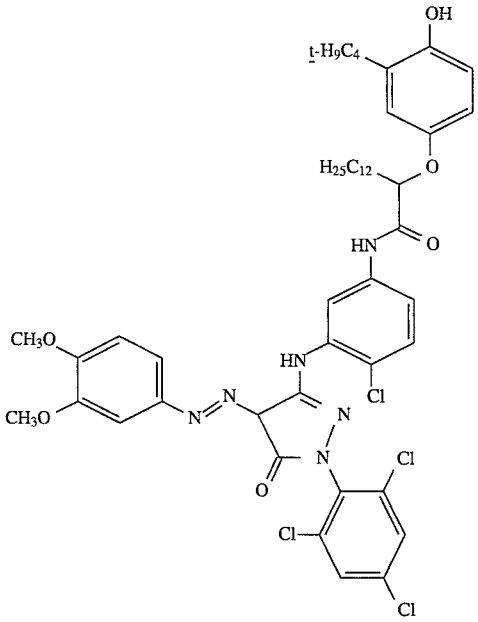
CC-1
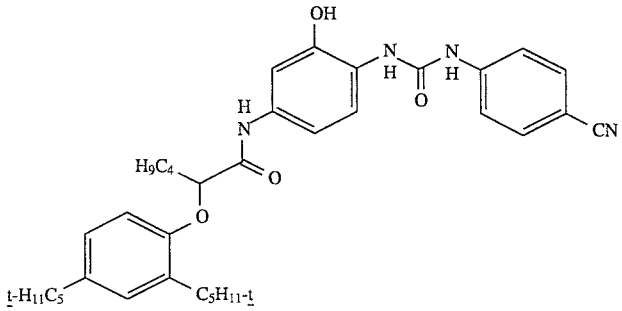

-continued
CM-1
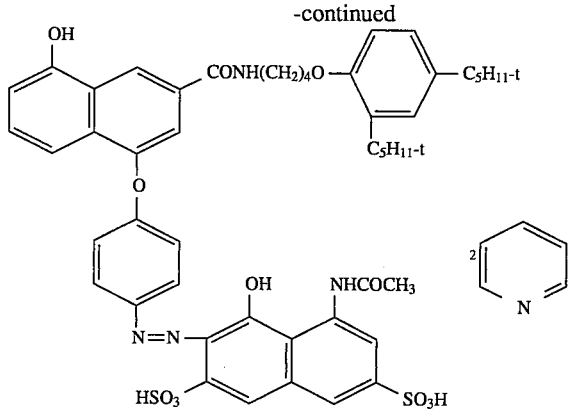
S-1
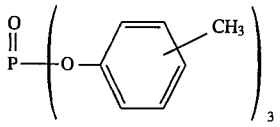
S-2
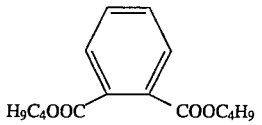
$C_{11}H_{23}CON(C_2H_5)_2$ S-3
S-4
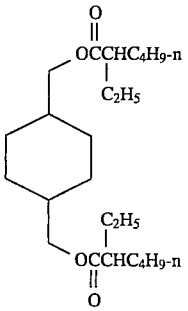
S-5
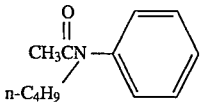
UV-1
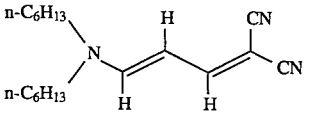
UV-2
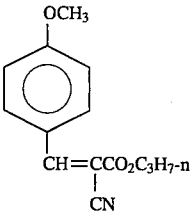
Hydrophilic Protective Overcoat Layer
A protective overcoat layer containing gelatin binder and matting agents listed in Table 1 is coated on the top of the UV layer and has the following composition:

TABLE 2

| COMPOSITION OF THE PROTECTIVE OVERCOAT LAYER | |
|---|---|
| Gelatin, lime processed | 888 mg/m$^2$ |
| Silicone lube, DC-200 (Dow Corning) | 40.1 mg/m$^2$ |
| Fluorad FC-134 (3M Co.) | 3.9 mg/m$^2$ |
| Aerosol OT (American Cyanamide) | 21.5 mg/m$^2$ |
| Surfactant Olin 10G (Olin Corp.) | 27.2 mg/m$^2$ |
| Matte 1 (Table 3) | |
| Matte 2 (Table 3) | |
| Matte 3 (Table 3) | |

Table 3 shows the compositions of the protective overcoat layers of each photographic element prepared. Samples are comparative and Examples are in accordance with the invention.

TABLE 3

| Coating No. | Matte 1 | Coverage mg/m2 | Matte 2 | Coverage mg/m2 | Matte 3 | Coverage mg/m2 |
|---|---|---|---|---|---|---|
| Sample 1 (Comparison) | P-4 | 53.8 | — | — | P-5 | 107.6 |
| Sample 2 (Comparison) | P-4 | 53.8 | P-6 | 161.4 | P-5 | 107.6 |
| Sample 3 (Comparison) | P-2 | 53.8 | — | — | P-5 | 107.6 |
| Sample 4 (Comparison) | P-3 | 53.8 | — | — | P-5 | 107.6 |
| Example 1 (Invention) | P-2 | 53.8 | P-1 | 161.4 | P-5 | 107.6 |
| Example 2 (Invention) | P-3 | 53.8 | P-1 | 161.4 | P-5 | 107.6 |

Evaluation of the RMS Granularity

The graininess of a photographic picture is caused by the developed dye clouds. Image silver and light scatter from matting agents in the protective overcoat layers. The Root Mean Square (RMS) Granularity is evaluated by the method described in ANSI Ph 2.40 (1985) entitled "Root Mean Square (RMS) Granularity of Film (Images on One Side Only)-Method for Measurement". By comparing RMS Granularity of the listed samples with a film that contains no matte, the granularity due to the matte is determined. The test results are reported in Table 4.

Evaluation of Ferrotyping Resistance

A group of six strips of the feature film (raw or processed) are placed in a 80 percent relative humidity (RH) chamber for a minimum of 16 hours. The strips are stacked, sensitized side to unsensitized side and wrapped in foil, placed inside a moisture proof wrap, and sealed. The sealed package is then placed above a flat glass plate and under a brass bar of the same size with weight of 6.89 kgs (15 lbs). The package, with the glass plate and brass bar is then placed in a 37.8° C. (100° F.) room for 17 hours. After storage, the bag is opened, the top and bottom strips are discarded, and the remaining strips are visually inspected for ferrotyping against the following scale:

| Value | % of area showing ferrotyping |
|---|---|
| A | 0 to <5 |
| B | 5 to <20 |
| C | 20 to <50 |
| D | 50 to 100 |

The testing results are reported in Table 4.

Evaluation of the Matte Cinch Abrasion

Five strips each (30.5 cm×35 mm) of film having the front side matte containing overcoat are conditioned to 21.1° C. (70° F.) and 50 percent relative humidity for 17 hours. The sample is fastened, with the film backing layer (back side) side up, in a fixture that contains a right angle edge which defines a vertical and horizontal surface. The samples containing the matte protective layer front side are placed over the samples containing the back side so that the front side is in contact with the back side of the affixed sample. A weight is affixed to the vertical surface of the front side sample. The front side samples are drawn in a horizontal direction away from the right angle. The samples are drawn at a weight of 10, 20, 50, 100, and 200 grams. The five samples containing the back side are qualitatively evaluated for resulting scratches under specular light (average): 0=no scratches, 1=few scratches, 2=some scratches, and 3=many scratches. The description of examples and the testing results are reported in Table 4.

TABLE 4

| Coating No. | Ferrotyping, Raw, 80% RH/37.8° C. | Ferrotyping, Processed (Mild) 80% RH/37.8° C. | Ferrotyping, Processed (Harsh) 80% RH/37.8° C. | Increase in RMS Granularity | Cinch Abrasion Rating |
|---|---|---|---|---|---|
| Sample 1 | 1 | B | C | 5 | 1 |
| Sample 2 | 1 | A | A | 5 | 1 |
| Sample 3 | 1 | B | B | 1.5 | 3 |
| Sample 4 | 1 | A | B | 3 | 3 |
| Example 1 | 1 | A | A | 1.5 | 1 |
| Example 2 | 1 | A | A | 3 | 1 |

The comparison samples 1 and 2 contain styrenic matte particles in the upper protective layer. They have excellent resistance to matte cinch abrasion. Sample 2 has good ferrotyping protection both before and after processing. However, both have unacceptable RMS granularity. Samples 3 and 4 contain 53.8 mg/m$^2$ of a 1.7 poly(methyl methacrylate) matte and a 2.4 μm poly(methy methacrylate) matte, respectively. They both show low RMS Granularity. However, they both have poor post process ferrotyping protection, particularly under harsh drying. Both samples have very poor resistance to matte cinch scratch and abrasion. On the other hand, Examples 1 and 2 contain poly(methyl methacrylate) matte particles of present invention, and they show unexpectedly superior performance in terms of good ferrotyping protection both before and after processing, low RMS granularity values, and superior resistance to matte cinch scratch and abrasion.

What is claimed is:

1. A photographic element comprises a support, at least one silver halide light-sensitive layer, and a protective overcoat comprising a hydrophilic binder and permanent matte particles, the permanent matte particles comprising a polymer of methyl methacrylate and having a size distribution of a first and a second mode, with the first mode being composed of particles having a mean particle size of from 0.2 to 1.2 micrometers in a coating weight of from 10 to 200 mg/m$^2$ and the second mode having a mean particle size of from 1.5 to 10 micrometers in a coating weight of from 5 to 150 mg/m$^2$, the total coating weight of the particles of the first and the second modes being greater than 100 mg/m$^2$.

2. The photographic element of claim 1 wherein the mean particle size of the first mode is from 0.5 to 1.2 micrometers.

3. The photographic element of claim 1 wherein the mean particle size of the first mode is from 0.7 to 1.2 micrometers.

4. The photographic element of claim 1 wherein the coating weight of the matte particles of the first mode is from 30 to 170 mg/m$^2$.

5. The photographic element of claim 1 wherein the coating weight of the matte particles of the first mode is from 50 to 150 mg/m$^2$.

6. The photographic element of claim 1 wherein the mean particle size of the second mode is from 1.5 to 5 micrometers.

7. The photographic element of claim 1 wherein the mean particle size of the second mode is from 1.5 to 3 micrometers.

8. The photographic element of claim 1 wherein the coating weight of the matte particles of the second mode is from 25 to 120 mg/m$^2$.

9. The photographic element of claim 1 wherein the coating weight of the second mode is from 50 to 100 mg/cm$^2$.

10. The photographic element of claim 1 wherein the permanent matte particles comprise greater than 80 mole percent of methyl methacrylate.

11. The photographic element of claim 1 wherein the protective overcoat layer is on the same side of the support as the light-sensitive layer and is further from the support than the light-sensitive layer.

12. The photographic element of claim 1 wherein the protective overcoat layer is on the opposite side of the support than the light-sensitive layer.

13. The photographic element of claim 1 wherein the protective overcoat layer also contains a processing removal matte.

14. The photographic element of claim 1 wherein the thickness of the uppermost layer of the protective overcoat layer is less than the mean particle size of the second mode of the permanent matte particles.

15. The photographic element of claim 1 wherein the permanent matte particles comprise greater than 80 mole percent methyl methacrylate.

* * * * *